US010392731B2

(12) United States Patent
Esponnette et al.

(10) Patent No.: US 10,392,731 B2
(45) Date of Patent: Aug. 27, 2019

(54) SYSTEMS AND METHODS FOR CREATING THREE-DIMENSIONAL WOVEN TEXTILE PRODUCTS

(71) Applicant: unspun, Inc., Palo Alto, CA (US)

(72) Inventors: Elizabeth Esponnette, Eugene, OR (US); Griffin Hovorka, Elmwood, NE (US)

(73) Assignee: UNSPUN, INC., Palo Alto, CA (US)

( * ) Notice: Subject to any disclaimer, the term of this patent is extended or adjusted under 35 U.S.C. 154(b) by 505 days.

(21) Appl. No.: 14/974,408

(22) Filed: Dec. 18, 2015

(65) Prior Publication Data

US 2016/0281277 A1 Sep. 29, 2016

Related U.S. Application Data

(60) Provisional application No. 62/139,756, filed on Mar. 29, 2015.

(51) Int. Cl.

| | |
|---|---|
| ***D03D 41/00*** | (2006.01) |
| ***D03C 9/06*** | (2006.01) |
| ***D03D 37/00*** | (2006.01) |
| ***D03J 1/00*** | (2006.01) |
| ***D03J 5/02*** | (2006.01) |

(52) U.S. Cl.

CPC ..... *D03D 41/00* (2013.01); *D03C 9/0633* (2013.01); *D03D 37/00* (2013.01); *D03J 1/00* (2013.01); *D03J 5/02* (2013.01)

(58) Field of Classification Search

CPC ..... D03D 41/00; D03D 41/007; D03D 37/00; D03J 1/00; D03C 9/0633

See application file for complete search history.

(56) References Cited

U.S. PATENT DOCUMENTS

| | | | | |
|---|---|---|---|---|
| 2,079,161 | A * | 5/1937 | Fisher | D03D 29/00 28/154 |
| 2,735,451 | A | 2/1956 | Christiansen et al. | |
| 2,924,250 | A | 2/1960 | Sidebotham | |
| 3,473,576 | A | 10/1969 | Amneus | |
| 2011/0318513 | A1 | 12/2011 | Marsal et al. | |

(Continued)

FOREIGN PATENT DOCUMENTS

| | | | |
|---|---|---|---|
| CN | 102950962 | A | 3/2013 |
| CN | 103966761 | A | 8/2014 |
| WO | WO-2013112714 | A1 | 8/2013 |

*Primary Examiner* — Shaun R Hurley
*Assistant Examiner* — Andrew Wayne Sutton
(74) *Attorney, Agent, or Firm* — Wilson Sonsini Goodrich & Rosati

(57) ABSTRACT

Described herein are techniques for creating a three-dimensional woven textile products. A method includes rotating strands of warp yarns, where each strand of warp yarn is in a direction away from a surface, in a circular motion while moving a strand of weft yarn forwards and backwards in a direction parallel to the surface so as to cause the strand of weft yarn to alternately weave in and out of the strands of warp yarn. The method includes moving the strand of weft yarn in a direction away from the surface so as to cause the strand of weft yarn to alternately weave in and out of the strands of warp yarn at a different height to create a three-dimensional woven textile product. The method includes supplying at least one of the strand of warp yarn or the strand of weft yarn with a yarn generator.

14 Claims, 17 Drawing Sheets

(56) References Cited

U.S. PATENT DOCUMENTS

| | | | | |
|---|---|---|---|---|
| 2012/0221038 | A1* | 8/2012 | Simpson | A61M 25/10 606/192 |
| 2013/0047467 | A1 | 2/2013 | Roether et al. | |
| 2014/0020192 | A1 | 1/2014 | Jones et al. | |
| 2016/0281277 | A1* | 9/2016 | Esponnette | D03C 9/0633 |

* cited by examiner

SYSTEMS AND METHODS FOR CREATING THREE-DIMENSIONAL WOVEN TEXTILE PRODUCTS

RELATED APPLICATION

This application relates to and claims priority under 35 U.S.C. § 119 (e) to U.S. Provisional Patent Application No. 62/139,756, titled "Creating textile products from chemical solutions using automated mechanisms and/or robotics to polymerize, weave and/or fuze," which was filed on Mar. 29, 2015, and is incorporated herein in its entirety.

FIELD OF THE INVENTION

The present invention is in the technical field of manufacturing woven textile products.

BACKGROUND OF THE INVENTION

Woven textile products are manufactured by interlacing fibers and/or yarns into grid-like patterns. There are two common types of woven textile products—woven textiles and knitted textiles. Both woven textiles and knitted textiles are typically laid out in grid-like patterns, but they are formed through different ways. FIG. 1A illustrates a piece of woven textile, where strands of yarn cross over and under to form a grid-like pattern. FIG. 1B illustrates a piece of knitted textile, where strands of yarn loop around to form a grid-like pattern.

Woven textiles have several advantages over knitted textiles. For example, woven textiles have better dimensional stability; that is, they do not stretch out of shape. They also have better coverage, which provides for thermal protection from heat or cold, and sun protection. Woven textiles also have a lower profile, which makes then less bulky and thick. In addition, they are also lighter because they require less yarn to cover the same area.

However, one disadvantage of woven textiles over knitted textiles is that creating a 3D woven product generally requires stitching together more than one distinct woven textile. The line where two distinct woven textiles are stitched together forms a seam. Different distinct woven textiles, and thus seams, are typically needed where the product changes dimension or direction, adds a new part, or changes the material of the yarn. For example, as described below in connection with FIG. 2, a woven shirt would normally require seams to connect different parts, such as the front, back, and the arms.

When different pieces of fabric are cut and sewn together, a certain amount of fabric will be wasted. Additionally, cutting and sewing fabrics is typically a manual process. Therefore, there has been a demand in the garment manufacturing industry to produce seamless garments in order to reduce both material and labor costs, and to leverage the economies of scale.

SUMMARY OF THE INVENTION

In accordance with the disclosed subject matter, systems and methods are provided for creating 3D woven textile products.

Disclosed subject matter includes, in one aspect, an apparatus for creating a three-dimensional woven textile product. The apparatus includes a base, a baseplate, an actuator, a weaving arm, and a controller. The baseplate is mounted on a top surface of the base. The baseplate has a two-dimensional configuration of holes along a top surface of the baseplate, where each of the holes has a strand of warp yarn that extends from the hole in a direction away from the top surface of the baseplate. The baseplate has an axis around which the baseplate is configured to rotate in a circular motion. The actuator is configured to move a strand of weft yarn forwards and backwards in a direction parallel to the top surface of the baseplate so as to cause the strand of weft yarn to alternately weave in and out of the strands of warp yarn. The weaving arm has mounted thereon the actuator, and is mounted on the top surface of the base. The weaving arm is configured to move the actuator in a direction away from the top surface of the baseplate so as to cause the strand of weft yarn to alternately weave in and out of the strands of warp yarn at a different height to create a 3D woven textile product. The controller is configured to control operation of the baseplate, the actuator, and the weaving arm.

Disclosed subject matter includes, in another aspect, a method for creating a three-dimensional woven textile product. The method includes creating a two-dimensional configuration of holes along a top surface of a baseplate; extending a strand of warp yarn from each of the holes in a direction away from the top surface of the baseplate; rotating the baseplate in a circular motion around an axis of the baseplate; while rotating the baseplate, moving a strand of weft yarn forwards and backwards in a direction parallel to the top surface of the baseplate so as to cause the strand of weft yarn to alternately weave in and out of the strands of warp yarn; while rotating the baseplate, moving the strand of weft yarn in a direction away from the top surface of the baseplate so as to cause the strand of weft yarn to alternately weave in and out of the strands of warp yarn at a different height to create a 3D woven textile product.

Disclosed subject matter includes, in yet another aspect, a non-transitory computer readable medium. The non-transitory computer readable medium comprises executable instructions operable to cause an apparatus to rotate a baseplate in a circular motion around an axis of the baseplate, where the baseplate has a two-dimensional configuration of holes along a top surface of the baseplate, where each of the holes has a strand of warp yarn that extends from the hole in a direction away from the top surface of the baseplate. The instructions are further operable to cause the apparatus to, while rotating the baseplate, move a strand of weft yarn forwards and backwards in a direction parallel to the top surface of the baseplate so as to cause the strand of weft yarn to alternately weave in and out of the strands of warp yarn. The instructions are further operable to cause the apparatus to move the strand of weft yarn in a direction away from the top surface of the baseplate so as to cause the strand of weft yarn to alternately weave in and out of the strands of warp yarn at a different height to create a 3D woven textile product.

Before explaining example embodiments consistent with the present disclosure in detail, it is to be understood that the disclosure is not limited in its application to the details of constructions and to the arrangements set forth in the following description or illustrated in the drawings. The disclosure is capable of embodiments in addition to those described and is capable of being practiced and carried out in various ways. Also, it is to be understood that the phraseology and terminology employed herein, as well as in the abstract, are for the purpose of description and should not be regarded as limiting.

These and other capabilities of embodiments of the disclosed subject matter will be more fully understood after a review of the following figures, detailed description, and claims.

It is to be understood that both the foregoing general description and the following detailed description are explanatory only and are not restrictive of the claimed subject matter.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In the following description, numerous specific details are set forth regarding the systems and methods of the disclosed subject matter and the environment in which such systems and methods may operate, etc., in order to provide a thorough understanding of the disclosed subject matter. It will be apparent to one skilled in the art, however, that the disclosed subject matter may be practiced without such specific details, and that certain features, which are well-known in the art, are not described in detail in order to avoid complication of the disclosed subject matter. In addition, it will be understood that the examples provided below are exemplary, and that it is contemplated that there are other systems and methods that are within the scope of the disclosed subject matter.

Figure 2:
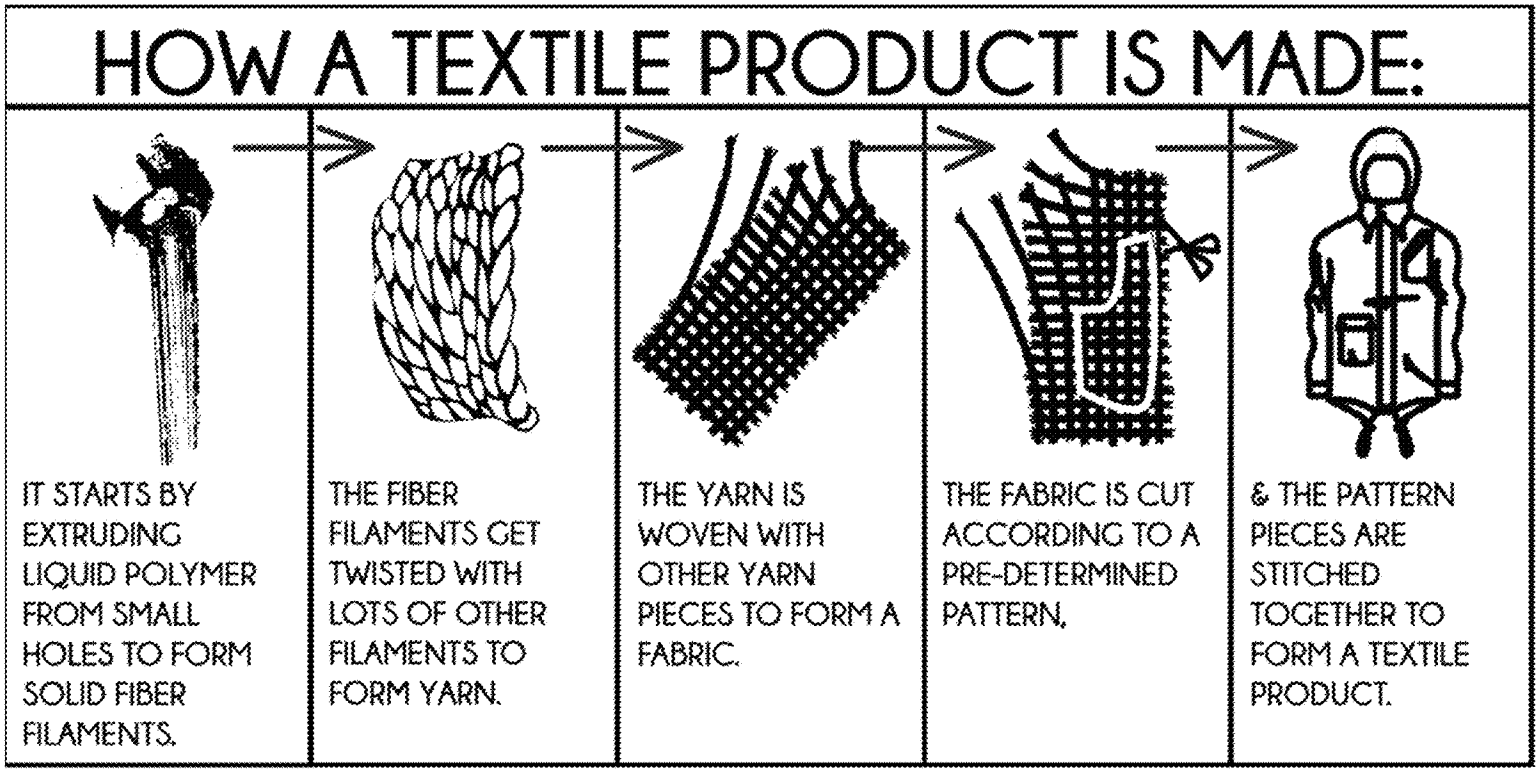
FIG. 2 (PRIOR ART)
FIG. 2 illustrates a traditional process of manufacturing woven textile products.

FIG. 2 illustrates a traditional process 200 of manufacturing woven textile products.

At step 202, a polymer is melted to become a solution. The polymer can be, for example, plastic, wood pulp, protein, mineral, or any other suitable material or combination of materials. The melted solution is then pushed through a spinneret to form filaments or fibers. The spinneret is generally in a configuration of a circular plate with multiple holes. The process 200 then proceeds to step 204.

At step 204, the filaments or fibers are twisted to form yarn. The process 200 then proceeds to step 206.

Figure 1A:
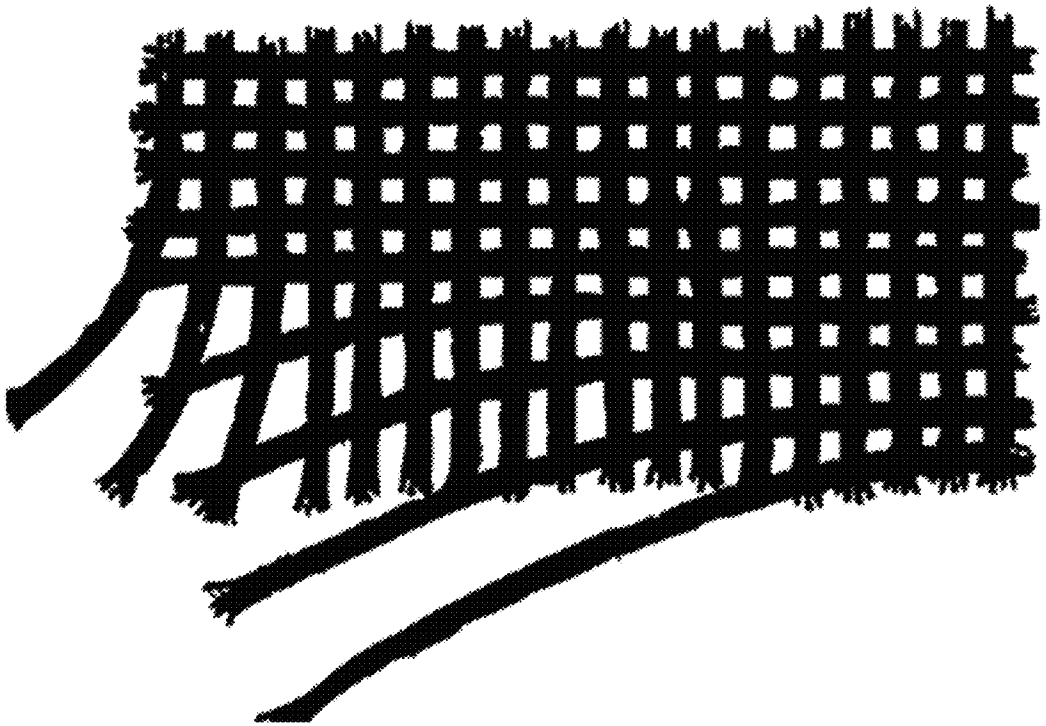
FIG. 1A (PRIOR ART)
FIG. 1A illustrates a piece of knitted textile.
Figure 1B:
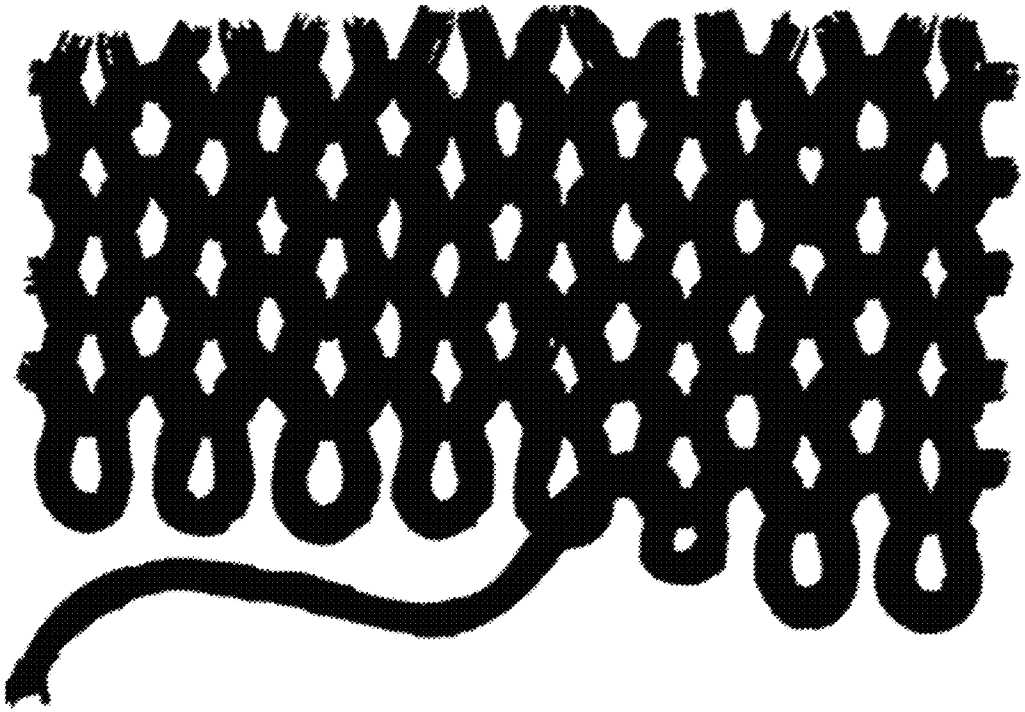
FIG. 1B (PRIOR ART)
FIG. 1B illustrates a piece of woven textile.

At step 206, strands of yarn are woven into a fabric. At this step, typically a loom is set up, where a plurality of strands of warp yarn are mounted on the loom. A strand of weft yarn is then crossed over and under the plurality of strands of warp yarn to form a fabric such as the one shown in FIG. 1A. The process 200 then proceeds to step 208.

At step 208, the fabric is cut into pattern pieces based on pre-determined patterns. Step 208 can be a manual process because the pre-determined patterns may have irregular shapes that are difficult to be handled by an automated process. The process 200 then proceeds to step 210.

At step 210, the pattern pieces are sewn together using seams to form a 3D textile product. The 3D textile product can be any suitable product such as, for example, a shirt, a vest, a coat, a pair of pants, a dress, a skirt, a pair of socks, shoes, a tent, a backpack, a parachute, a composite boat shell, a composite plane shell, a composite bike shell, a sleeping bag shell, etc. Step 210 can also be a manual process because the pattern pieces may need to be re-orientated manually during the stitching/sewing process.

The process 200 has several drawbacks. First, at least steps 208 and 210 are typically manual processes, and therefore it is difficult to capitalize the economies of scale. Second, cutting and sewing fabrics into a product require seams, which are generally less desirable than seamless products. Seamless products advantageously provide several benefits. For example, they are typically less bulky, more comfortable, and lighter. They also have a stronger structure—seams create weak points where failure often happens. They provide more insulation against the elements such as water, wind, heat, or cold. They are also more dimensionally stable.

Figure 3A:
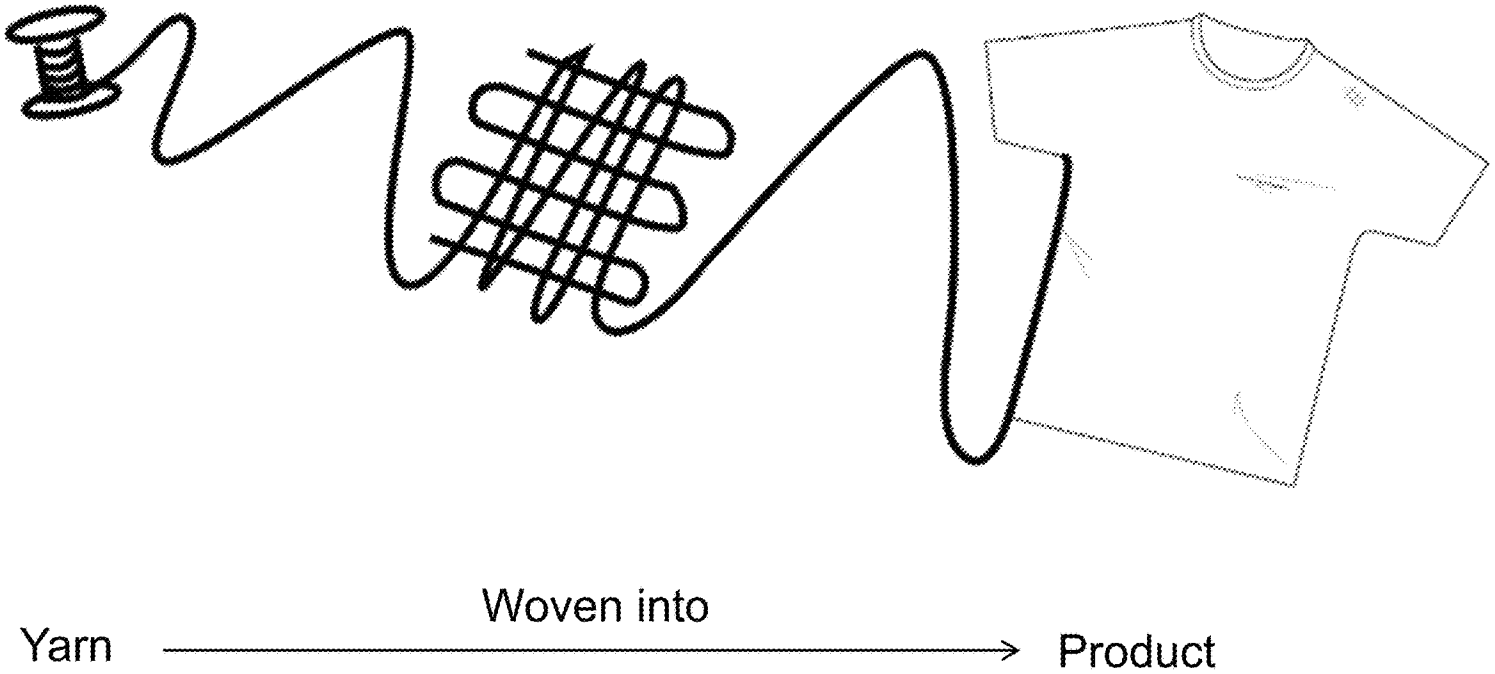
FIGS. 3A-3B illustrate a process of manufacturing woven textile products in accordance with an embodiment of the disclosed subject matter.
Figure 3B:
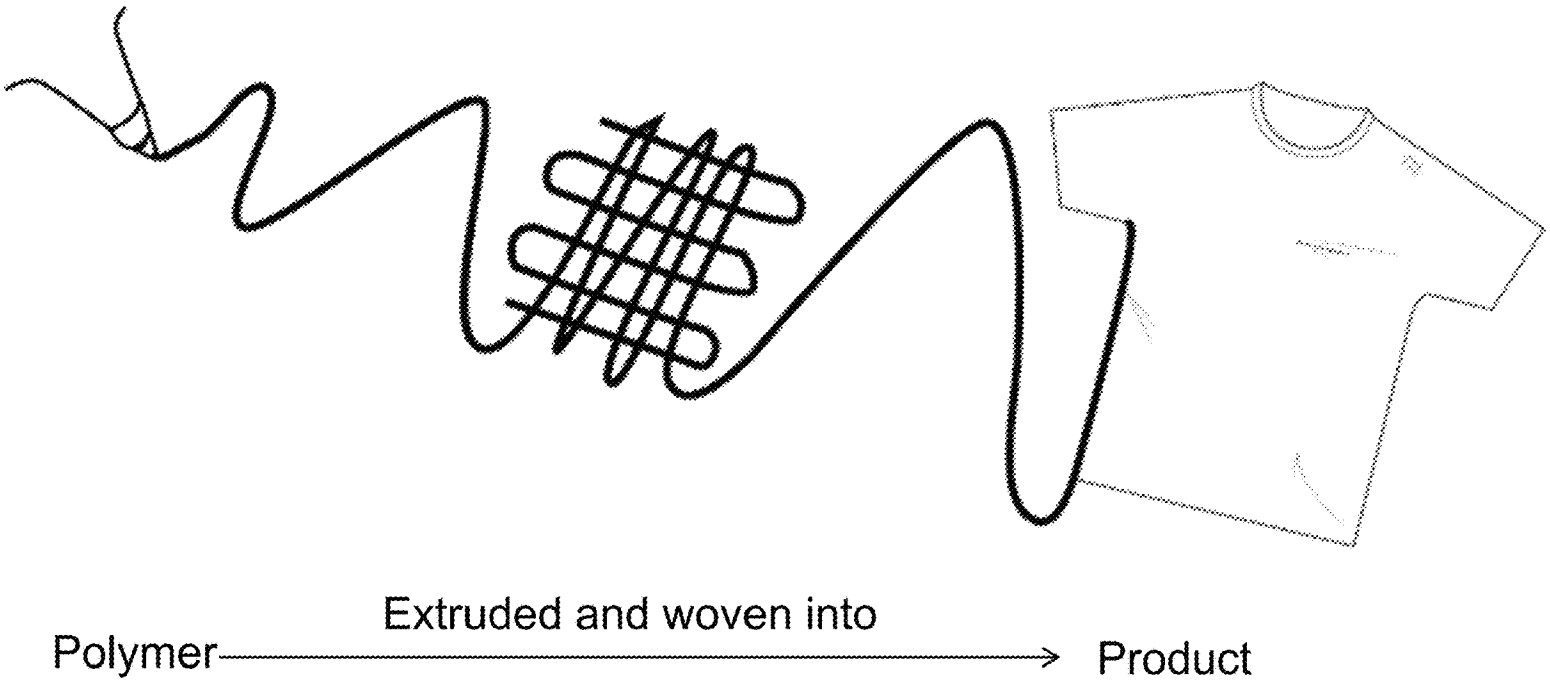

The present invention bypasses certain steps of the traditional process. In one embodiment of the present invention, as illustrated in FIG. 3A, strands of yarn are woven into a seamless 3D product. In another embodiment of the present invention, as illustrated in FIG. 3B, a polymer or solution can be extruded and woven into a seamless 3D product.

Figure 4:
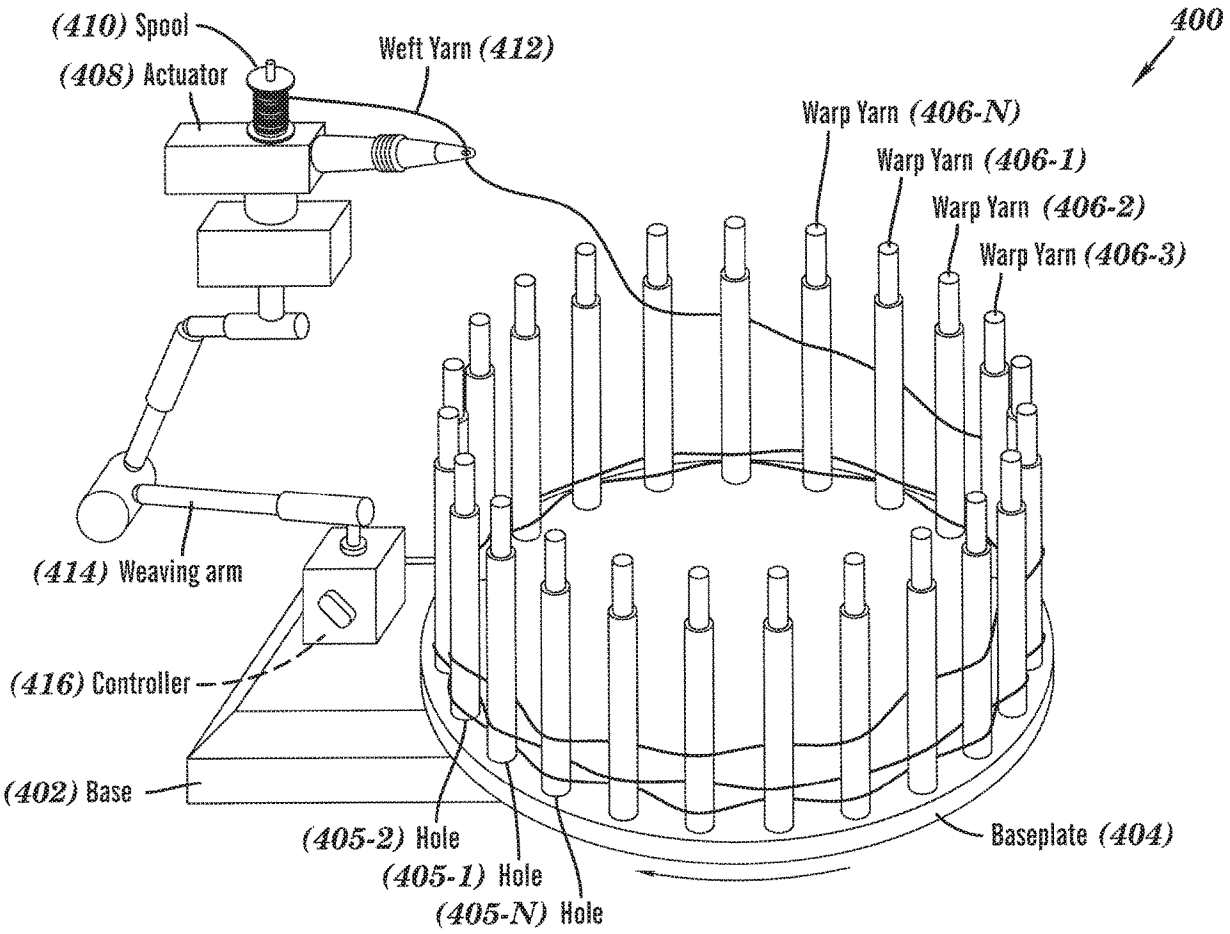
FIG. 4 illustrates a system for creating woven textile products in accordance with an embodiment of the disclosed subject matter.

FIG. 4 illustrates a system 400 for creating woven textile products in accordance with an embodiment of the present invention. The system 400 includes a base 402, a baseplate 404, one or more holes 405 (e.g., hole 405-1, 405-2, . . . 405-N), more than one strand of warp yarn 406 (e.g., warp yarn 406-1, 406-2, . . . 406-N), an actuator 408, a spool 410 containing a strand of weft yarn 412, a weaving arm 414, and a controller 416. The components included in the system 400 can be further broken down into more than one component and/or combined together in any suitable arrangement. Further, one or more components can be rearranged, changed, added, and/or removed.

The base 402 can be included in the system 400 as a support for the baseplate 404, the weaving arm 414, and/or other suitable components of the system 400. For example, in some embodiments, the baseplate 404 and/or the weaving arm 414 can be mounted on a top surface of the base 402. In some embodiments, the base 402 and the baseplate 404 are separate components. In some embodiments, the base 402 and the baseplate 404 are integrated together. The base 402 can be in any suitable shapes, such as, for example, circular, square, rectangular, or any other geometric or non-geometric shape.

As described above, the baseplate 404 can be mounted on the top surface of the base 402. The baseplate 404 can be in any suitable shape, such as, for example, circular, square, rectangular, or any other geometric or non-geometric shape. A plurality of strands of warp yarn 406 can be coupled to a top surface of the baseplate 404. The number, location, and/or orientation of the plurality of strands warp yarn 406 can be fixed, or alternatively, dynamically adjustable before, during, and/or after the weaving process. In some embodiments, the baseplate 404 can have a two-dimensional configuration of holes 405 along the top surface of the baseplate, and each of the holes 405 can have one or more strands of warp yarn 406 that extend from the hole 405 in a direction away from the top surface of the baseplate 404. The directions of the strands of warp yarn 406 can be uniform or non-uniform. For example, in some embodiments, the direction that the strand of warp yarn 406 extends from each hole 405 away from the top surface of the baseplate can be (1) the same for all strands of warp yarn 406; (2) the same for at least two strands of warp yarn 406; or (3) different for each strand of warp yarn 406. Further, the direction that the strand of warp yarn 406 extends from each hole 405 away from the top surface of the baseplate 404 can be dynamically adjustable during the weaving process. In some embodiments, a location of each of the holes 405 along the top surface of the baseplate 404 is dynamically adjustable. In some embodiments, at least one hole 405 can be added along the top surface of the baseplate 404, and the at least one hole 405 has one or more strands of warp yarn 406 that extend from the at least one hole 405 in a direction away from the top surface of the baseplate 404. In some embodiments, one or more strands of warp yarn 406 can be dynamically removed from respective one or more holes 405. In some embodiments, the location of one or more holes 405 can be dynamically adjustable along the top surface of the baseplate 404. For example, one or more holes 405 can be dynamically moved towards the outer edge of the baseplate 404, towards the center of the baseplate 704, or any suitable combination thereof. In some embodiments, the movement of one or more holes 405 can be tracked and controlled by the controller 416.

The holes 405 described in the system 400 can have any suitable two-dimensional configurations such as, for example, circular, triangular, rectangular, square, or any other geometric or non-geometric shape. In some embodiments, the holes 405 can be three-dimensional as well. The holes 405 can include any suitable means to support and/or hold the strands of warp yarn 406 and do not need to have a physical opening. A non-limiting example of the hole 405 can be one or more clips coupled to the baseplate 404 and configured to hold one or more strands of warp yarn 406. In some embodiments, additional components can be coupled to the holes 405 to support and/or hold the strands of warp yarn 406. For example, in some embodiments, a hollow tube can be coupled to each hole 405, and one or more strands of warp yarn 406 can be placed inside the tube so that the warp can stay at a desired direction. In these embodiments, the tubes can be removed after the weaving process.

The baseplate 404 can be configured to rotate in a circular motion. For example, the baseplate 404 can be configured to rotate around its axis. The rotation can be clockwise or counterclockwise. In some embodiments, the circular motion of the baseplate 404 is in parallel with the top surface of the baseplate 404. As described in detail below, in some embodiments, the motion of the baseplate 404 can be controlled and coordinated by the controller 416.

The actuator 408 can be coupled, directly or indirectly, with one or more strands of weft yarn 412. The actuator 408 can be driven by electrical signals, mechanical force, hydraulic liquid pressure, or any other suitable energy forms or combination thereof. For example, the actuator 408 can be a solenoid actuator, a pneumatic jet, and/or any suitable motor. The actuator 408 can have any suitable configuration. For example, the actuator 408 can have the configurator of tweezer-like grippers. In some embodiments, the actuator 408 can be configured to move the weft yarn 412 forwards and backwards in a direction parallel to the top surface of the baseplate 404 while the baseplate 404 and the strands of warp yarn 406 are configured to rotate in a circular motion. In some embodiments, the controller 416 can be configured to control the timing and/or location of the movements of the actuator 408 and the baseplate 404 so as to cause the weft yarn 412 to alternately weave in and out of the strands of warp yarn 406. FIG. 4 shows that the weft yarn 412 is supplied by the spool 410. In some embodiments, the weft yarn 412 and/or one or more strands of warp yarn 406 can be supplied by a yarn generator, which is described in detail below in connection with FIG. 12.

The actuator 408 is mounted on the weaving arm 414, which is mounted on the top surface of the base 402. The weaving arm 414 can be configured to move the actuator 408 in a direction away from the top surface of the baseplate 404 so as to cause the strand of weft yarn 412 to alternately weave in and out of the strands of warp yarn 406 at a different height to create a 3D woven textile product. For example, in some embodiments, after the actuator 408 has caused the strand of weft yarn 412 to alternately weave in and out of each of the strands of warp yarn 406 approximately once at a particular height, the weaving arm 414 can be configured to move the actuator 408 up or down to a different height and continue the weaving process. The weaving arm 414 can be driven by electrical signals, mechanical force, hydraulic liquid pressure, or any other suitable energy forms or combination thereof. For example, the weaving arm 414 can be an actuator, a pneumatic jet, and/or any suitable motor. In some embodiments, the controller 416 can be configured to control the timing and/or location of the movements of the weaving arm 414.

Figure 5:
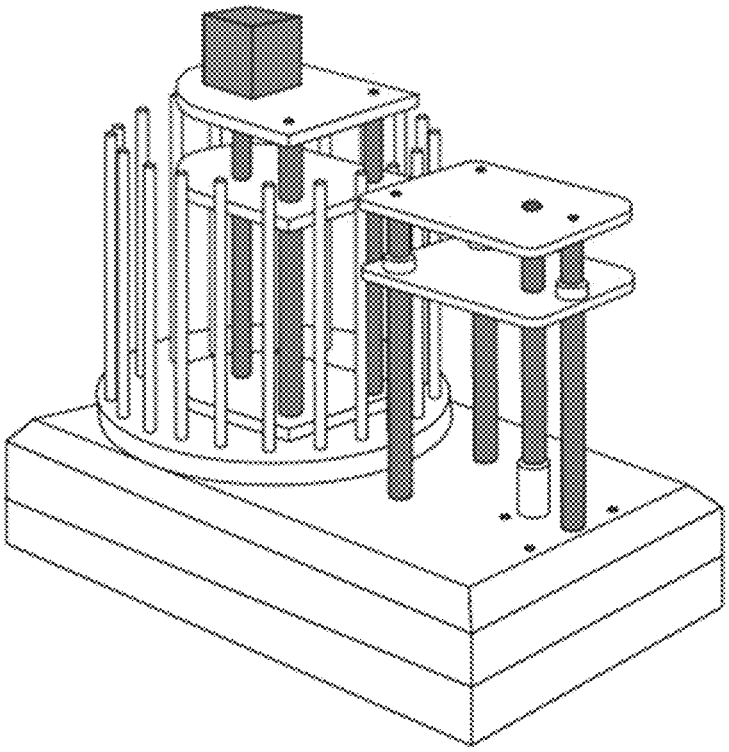
FIG. 5 illustrates a system for creating woven textile products in accordance with an embodiment of the disclosed subject matter.

In some embodiments, the system 400 can include a controller 416. The controller 416 can be configured to control and coordinate the operation of the baseplate 404, one or more holes 405, the actuator 408, the weaving arm 414, and/or any other suitable component of the system 400. As a non-limiting example, the controller 416 can control and track the movement of one or more strands of warp yarn 406 directly or indirectly by controlling the movement of the baseplate 404, one or more holes 405, and/or any other suitable component of the system 400. Knowing the positions of the one or more strands of warp yarn 406, the controller 416 can control the actuator 408, the weaving arm 414, and/or other suitable component of the system 400 so as to cause the weft yarn 412 to alternately weave in and out of the strands of warp yarn 406. In some embodiments, the controller 416 can also be configured to control the actuator 408, the weaving arm 414, and/or other suitable components of the system 400 so as to cause the weft yarn 412 to stitch into and/or around one or more strands of warp yarn 406. The controller 416 can control the components of the system 400 through electrical signals, mechanical force, hydraulic liquid pressure, or any other suitable energy forms or combination thereof. In some embodiments, the controller 416 can be embedded in the system 400 and located at any suitable location of the system 400. In some embodiments, the controller 416 can be further broken down into one or more sub-controllers. For example, the baseplate 404, the actuator 408, and the weaving arm 414 can be each controlled by a sub-controller. In some embodiments, the controller 416 is located separated from the system 400. For example, the controller 416 can be located remotely and control components of the system 400 through wireless signals. Non-limiting examples the controller 416 include desktop computers, portable computers, embedded microcontrollers, smartphones, tablets, and any suitable devices that can communicate remotely or locally with other components The system 400 can have any suitable shape and/or arrangement of the components. For example, FIG. 5 shows a system 400 in accordance with another embodiment of the present invention.

Figure 6:
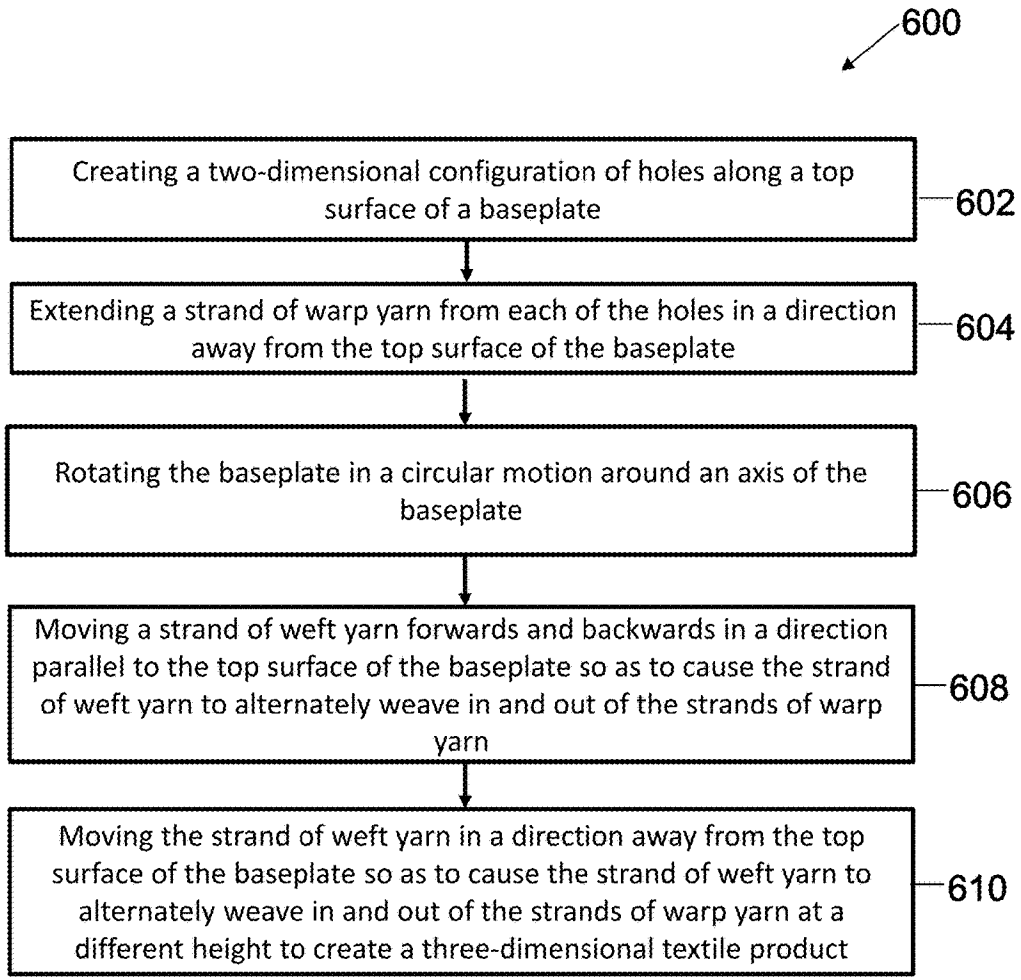
FIG. 6 is a flow chart illustrating a process of creating 3D woven textile products in accordance with an embodiment of the disclosed subject matter.

FIG. 6 is a flow chart illustrating a process 600 of creating 3D woven textile product in accordance with an embodiment of the disclosed subject matter. The process 600 is illustrated in connection with the system 400 shown in FIG. 4. In some embodiments, the process 600 can be modified by, for example, having steps rearranged, changed, added, and/or removed.

At step 602, a plurality of two-dimensional configuration of holes 405 are created along the top surface of the baseplate 404. In some embodiments, one or more holes 405 can be dynamically added during the weaving process. The process 600 then proceeds to step 604.

At step 604, one or more strands of warp yarn 406 are set up and extended from each of the holes 405 in a direction away from the top surface of the baseplate 404. As described above, the directions of the strands of warp yarn 406 can be uniform or non-uniform. For example, in some embodiments, the direction that the strand of warp yarn extends from each hole 405 away from the top surface of the baseplate can be (1) the same for all strands of warp yarn; (2) the same for at least two strands of warp yarn; or (3) different for each strand of warp yarn. Further, the direction that the strand of warp yarn extends from each hole 405 away from the top surface of the baseplate can be dynamically adjustable during the weaving process. The process 600 then proceeds to step 606.

At step 606, the baseplate 404 is rotated in a circular motion. Because the strands of warp yarn 406 are extended from the holes 405 that are along the top surface of the baseplate 404, the strands of warp yarn 406 are also rotated in a circular motion together with the baseplate 404. The rotation can be clockwise or counterclockwise. In some embodiments, the circular motion of the baseplate 404 is in parallel with the top surface of the baseplate 404 and around an axis of the baseplate 404. The process 600 then proceeds to step 608.

At step 608, a strand of weft yarn 412 is moved forwards and backwards in a direction parallel to the top surface of the baseplate 404 so as to cause the strand of weft yarn 412 to alternately weave in and out of the strands of warp yarn 406. In some embodiments, the strand of weft yarn 412 can be moved forwards and backwards by an actuator 408, a weaving arm 414, and/or any other suitable motors. The process 600 then proceeds to step 610.

At step 610, the strand of weft yarn 412 is moved in a direction away from the top surface of the baseplate 404 so as to cause the strand of weft yarn 412 to alternately weave in and out of the strands of warp yarn 406 at a different height to create a 3D woven textile product. In some embodiments, the strand of weft yarn 412 can be moved in the direction away from the top surface of the baseplate 404 by the actuator and/or the weaving arm 414. As described above, in some embodiments, a controller 416 can be included and configured to control and coordinate the operation of the baseplate 404, the actuator 408, and/or the weaving arm 414.

Figure 7:
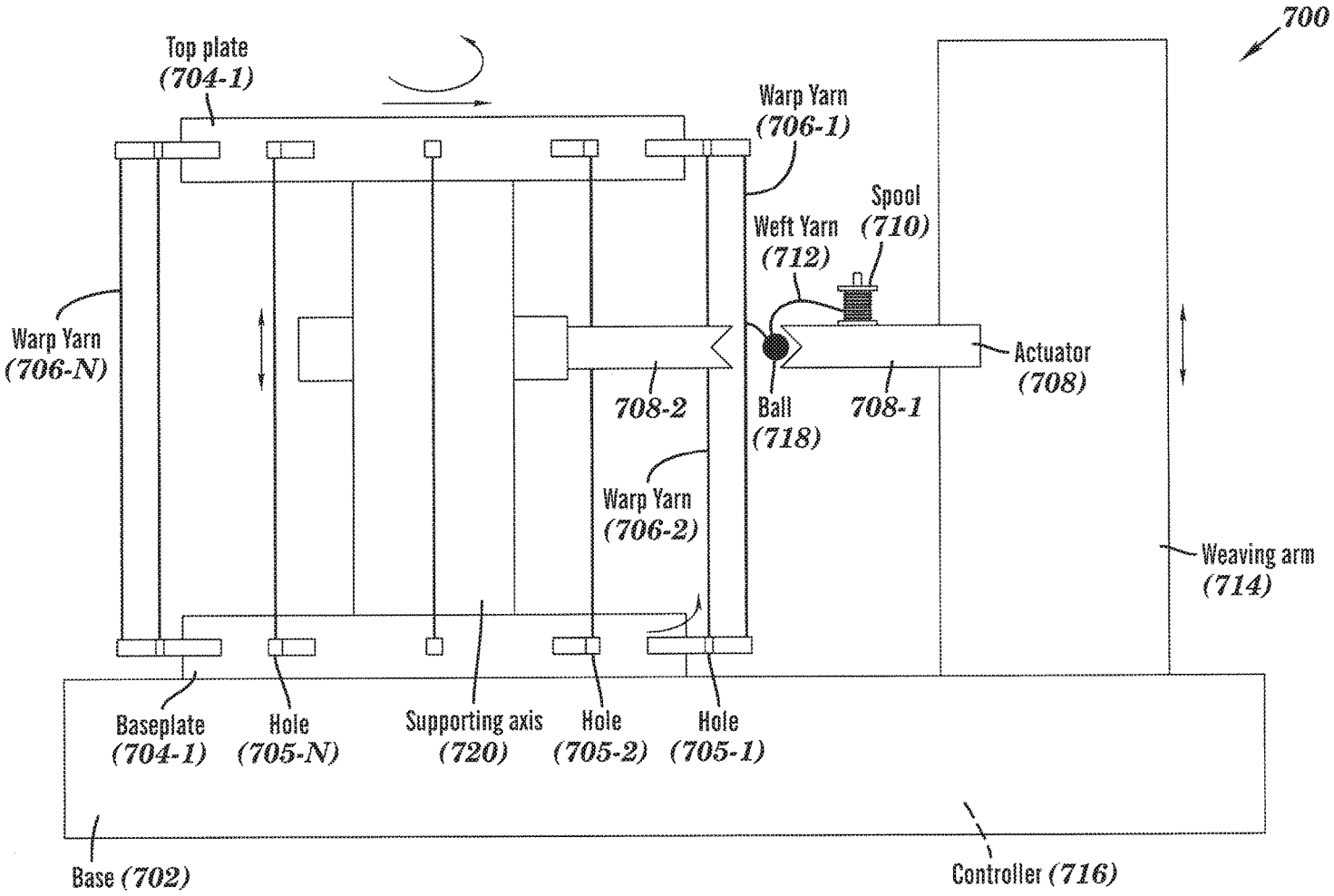
FIG. 7 illustrates a system for creating woven textile products in accordance with an embodiment of the disclosed subject matter.

FIG. 7 illustrates a system 700 for creating woven textile products in accordance with an embodiment of the present invention. The system 700 includes a base 702, a baseplate 704-1, a top plate 704-2, one or more holes 705 (e.g., hole 705-1, 705-2, . . . 705-N), more than one strand of warp yarn 706 (e.g., warp yarn 706-1, 706-2, . . . 706-N), an actuator 708, a spool 710 containing a strand of weft yarn 712, a weaving arm 714, a controller 716, a ball 718, and a supporting axis 720. The components included in the system 700 can be further broken down into more than one component and/or combined together in any suitable arrangement. Further, one or more components can be rearranged, changed, added, and/or removed.

The base 702 can be included in the system 700 as a support for the baseplate 704, the weaving arm 714, and/or other suitable components of the system 700. For example, in some embodiments, the baseplate 704 and/or the weaving arm 714 can be mounted on a top surface of the base 702. In some embodiments, the base 702 and the baseplate 704 are separate components. In some embodiments, the base 702 and the baseplate 704 are integrated together. The base 702 can be in any suitable shapes, such as, for example, circular, square, rectangular, or any other geometric or non-geometric shape.

As described above, the baseplate 704-1 can be mounted on the top surface of the base 702. The baseplate 704-1 can be coupled to the top plate 704-2 through the supporting axis 720. The baseplate 704-1 and the top plate 704-2 can be in any suitable shape, such as, for example, circular, square, rectangular, or any other geometric or non-geometric shape. In some embodiments, the baseplate 704-1 can have a two-dimensional configuration of holes 705, and the top plate 704-2 can also have a two-dimensional configuration of holes 705. Each of the holes 705 on the baseplate 704-1 can have one or more strands of warp yarn 706 that extend from the hole 705 in a direction away from the baseplate 704-1. In some embodiments, each strand of warp yarn 706 extending from the baseplate 704-1 can be coupled to a hole 705 on the top plate 704-2 such that one or more strands of warp yarn 706 can be held between a hole 705 on the baseplate 704-1 and a hole 705 on the top plate 704-2. The number, location, and/or orientation of the plurality of strands warp yarn 706 can be fixed, or alternatively, dynamically adjustable before, during, and/or after the weaving process. The one or more strands of warp yarn 706 can be held in a direction away from the baseplate 704-1. The directions of the strands of warp yarn 706 can be uniform or non-uniform. For example, in some embodiments, the direction that the strand of warp yarn extends from each hole 705 on the baseplate 704-1 away from the baseplate 704-1 can be (1) the same for all strands of warp yarn 706; (2) the same for at least two strands of warp yarn 706; or (3) different for each strand of warp yarn 706. Further, the direction that the strand of warp yarn 706 extends from each hole 705 away from the baseplate 704-1 can be dynamically adjustable during the weaving process. In some embodiments, a location of each of the holes 705 along the baseplates 704-1 and/or the top plate 704-2 is dynamically adjustable. In some embodiments, at least one hole 705 can be added along the baseplate 704-1, and the at least one hole 705 has one or more strands of warp yarn that extend from the at least one hole 705 in a direction away from the baseplate 704-1. In some embodiments, at least one hole can be added along the top plate 704-2, and the at least one hole 705 can be coupled to one or more strands of warp yarn 706 that extend from the baseplate 704-1. In some embodiments, one or more strands of warp yarn 706 can be dynamically removed from respective one or more holes 705 along the baseplate 704-1 and/or the top plate 704-2. In some embodiments, the location of one or more holes 705 can be dynamically adjustable along the top surface of the baseplate 704-1. For example, one or more holes 705 can be dynamically moved towards the outer edge of the baseplate 704-1, toward the center of the baseplate 704-1, or any suitable combination thereof. In some embodiments, the movement of one or more holes 705 can be tracked and controlled by the controller 716.

The holes 705 described in the system 700 can have any suitable two-dimensional configurations such as, for example, circular, triangular, rectangular, square, or any other geometric or non-geometric shape. In some embodiments, the holes 705 can be three-dimensional as well. The holes 705 can include any suitable means to support and/or hold the strands of warp yarn 706 and do not need to have a physical opening. A non-limiting example of the hole 705 can be one or more clips coupled to the baseplate 704-1 and configured to hold one or more strands of warp yarn 706. In some embodiments, additional components can be coupled to the holes 705 to support and/or hold the strands of warp yarn. For example, in some embodiments, a hollow tube can be coupled between a hole 705 on the baseplate 704-1 and a hole 705 on the top plate 704-2, and one or more strands of warp yarn 706 can be placed inside the tube so that the warp can stay at a desired direction. In these embodiments, the tubes can be removed after the weaving process.

The baseplate 704-1 can be configured to rotate in a circular motion. For example, the baseplate 704-1 can be configured to rotate around its axis. The rotation can be clockwise or counterclockwise. In some embodiments, the circular motion of the baseplate 704-1 is in parallel with the top surface of the baseplate 704-1. The top plate 704-2 can be rotated along with the baseplate 704-1 through the supporting axis 720. As described in detail below, in some embodiments, the motion of the baseplate 704-1 can be controlled and coordinated by the controller 716.

The actuator 708 can be configured to move one or more strands of weft yarn 712. The actuator 708 can be driven by electrical signals, mechanical force, hydraulic liquid pressure, or any other suitable energy forms or combination thereof. For example, the actuator 708 can be a solenoid actuator, a pneumatic jet, and/or any suitable motor. The actuator 708 can have any suitable configuration. For example, the actuator 708 can have the configurator of tweezer-like grippers. In the system 700, the one or more strands of weft yarn 712 can be coupled to a ball 718. Also in the system 700, the actuator 708 comprises a first arm 708-1 and a second arm 708-2. In some embodiments, the first arm 708-1 and/or the second arm 708-2 can be configured to move forwards and backwards and alternately hold the ball 718 such that the ball 718 and the weft yarn 712 are moved forwards and backwards in a direction parallel to the top surface of the baseplate 704-1 while the baseplate 704-1, the top plate 704-2, and the strands of warp yarn 706 are configured to rotate in a circular motion. In some embodiments, the ball 718 is a magnetic ball and can be moved between the first arm 708-1 and the second arm 708-2 through a change of electro-magnetic field between the two arms. When the ball 718 is moved by the change of the electro-magnetic field, the first arm 708-1 and the second arm 708-2 may not necessarily move forwards and backwards toward each other. In some embodiments, the controller 716 can be configured to control the timing and/or location of the movements of the first arm 708-1, the second arm 708-2, and the baseplate 704 so as to cause the weft yarn 712 to alternately weave in and out of the strands of warp yarn 706. FIG. 7 shows that the weft yarn 712 is supplied by the spool 710. In some embodiments, the weft yarn 712 and/or one or more strands of warp yarn 706 can be supplied by a yarn generator, which is described in detail below in connection with FIG. 12.

Figure 8A:
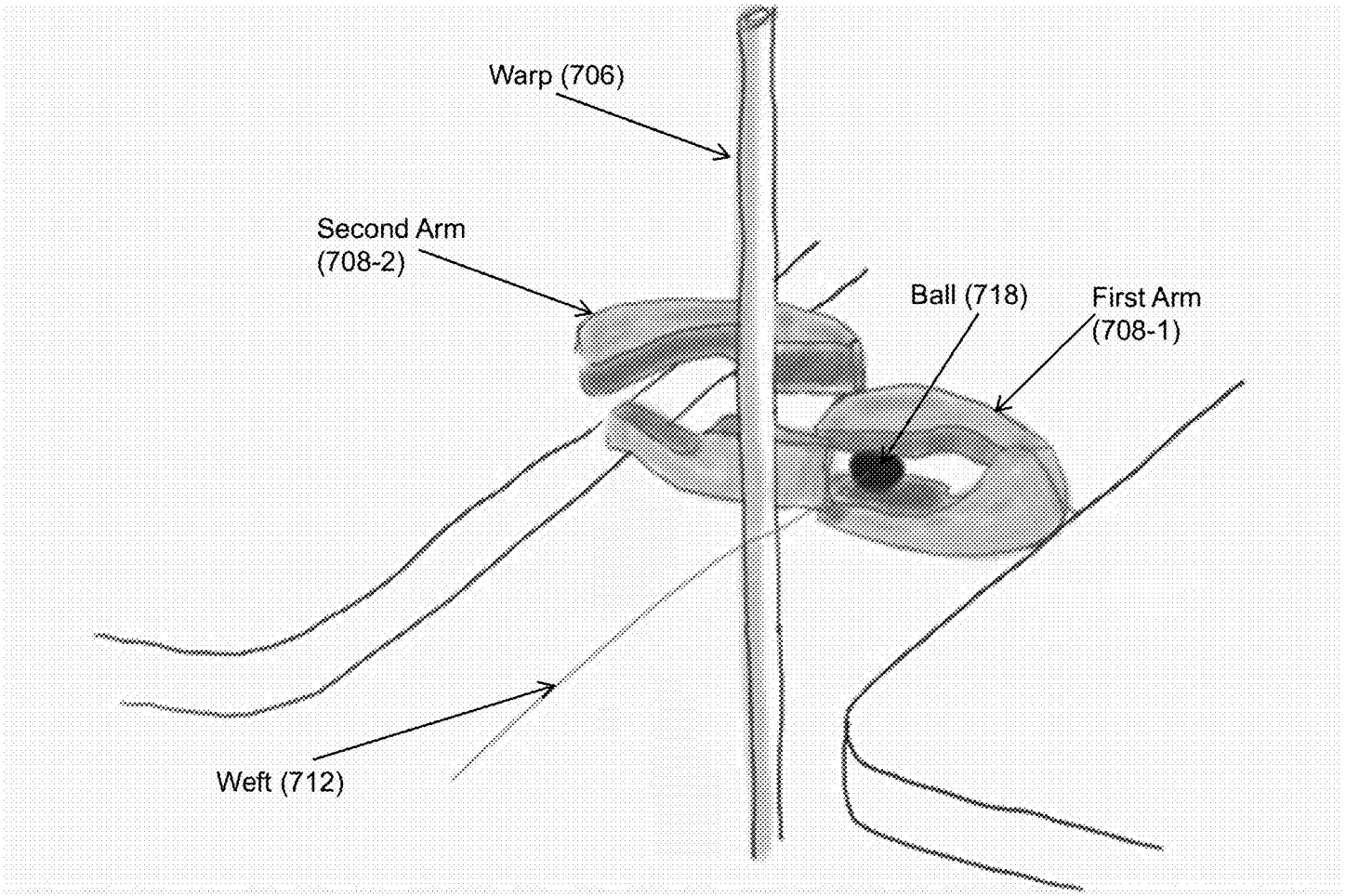
FIGS. 8A and 8B illustrate a process of weaving warp yarn and weft yarn in accordance with an embodiment of the disclosed subject matter.
Figure 8B:
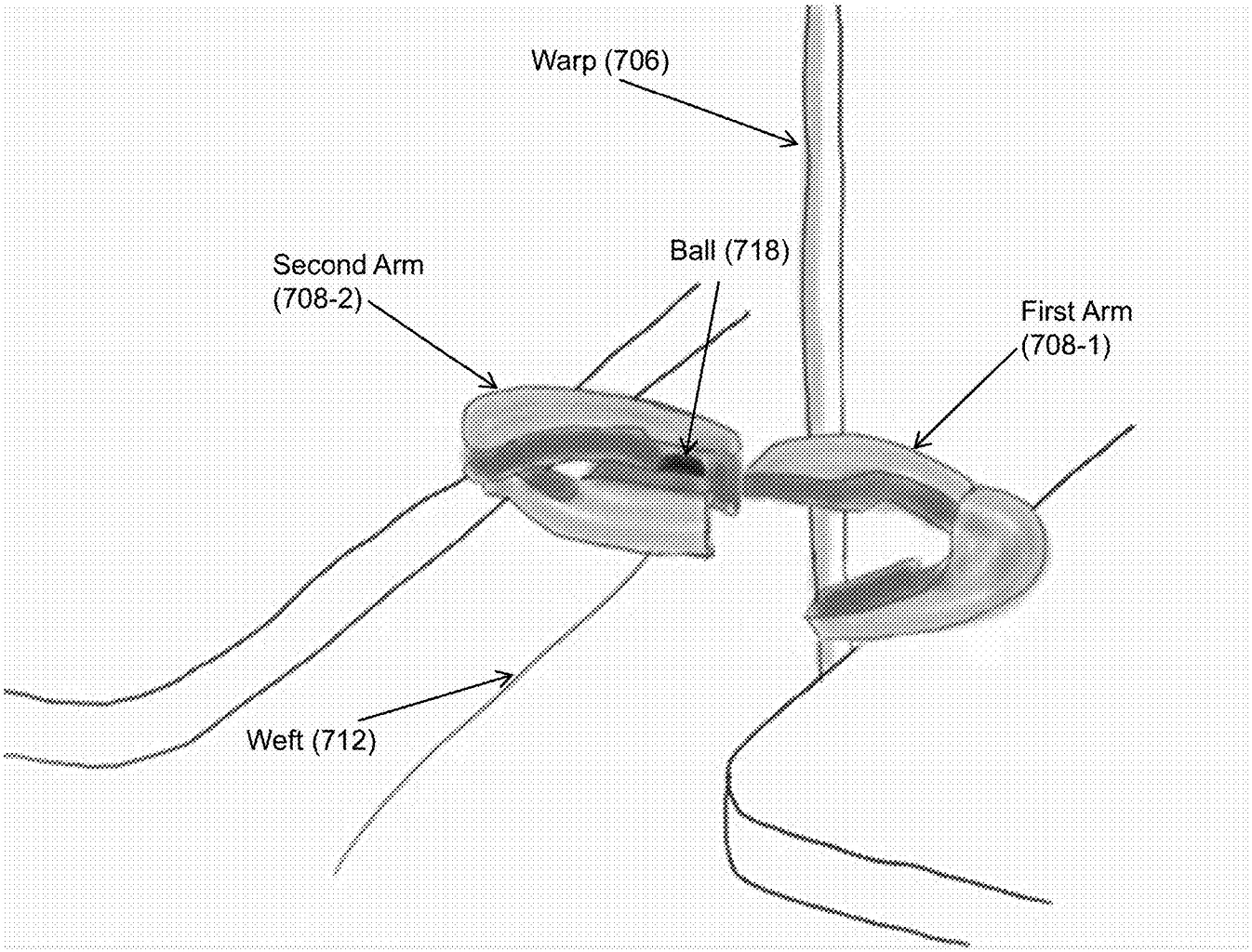

FIGS. 8A and 8B illustrate how the weft yarn 712 can be moved forwards and backwards by the first arm 708-1 and the second arm 708-2 of the actuator 708 so as to cause the weft yarn 712 to alternately weave in and out of the strands of warp yarn 706. In FIG. 8A, the first arm of the actuator 708-1 holds the ball 718 and the weft yarn 712. The first arm 708-1 moves the ball 718 and the weft yarn 712. The first arm 708-1 can move toward the second arm 708-2 to hand over the ball 718 and the weft yarn 712 to the second arm 708-2. In the meantime, the warp yarn 706 can be configured to rotate in a circular motion and pass through between the first arm 708-1 and the second arm 708-2. In FIG. 8B, the ball 718 and the weft yarn 712 are handed over to the second arm 708-2 from the first arm 708-1 while the warp yarn 706 continues rotating through between the first arm 708-1 and the second arm 708-2. In some embodiments, the controller 716 can be used to control the timing and/or location of the movements of the first arm 708-1, the second arm 708-2, and the warp yarn 706 so as to cause the weft yarn 712 to alternately weave in and out of the strands of warp yarn 706. In some embodiments, both the first arm 708-1 and the second arm 708-2 can move forwards and backwards toward each other. In some embodiments, only the first arm 708-1 or the second arm 708-2 can move forwards and backwards.

One or both arms of the actuator 708 can be mounted on the weaving arm 714, which is mounted on the top surface of the base 702. The weaving arm 714 can be configured to move the actuator 708 in a direction away from the top surface of the baseplate 704-1 so as to cause the strand of weft yarn 712 to alternately weave in and out of the strands of warp yarn 706 at a different height to create a 3D woven textile product. For example, in some embodiments, after the actuator 708 has caused the strand of weft yarn 712 to alternately weave in and out of each of the strands of warp yarn 706 approximately once at a particular height, the weaving arm 714 can be configured to move the actuator 708 up or down to a different height and continue the weaving process. The weaving arm 714 can be driven by electrical signals, mechanical force, hydraulic liquid pressure, or any other suitable energy forms or combination thereof. For example, the weaving arm 714 can be an actuator, a pneumatic jet, and/or any suitable motor. In some embodiments, the controller 716 can be configured to control the timing and/or location of the movements of the weaving arm 714.

In some embodiments, the system 700 can include a controller 716. The controller 716 can be configured to control and coordinate the operation of the baseplate 704-1, the top plate 704-2, one or more holes 705, the actuator 708, the weaving arm 714, and/or any other suitable component of the system 700. As a non-limiting example, the controller 716 can control and track the movement of one or more strands of warp yarn 706 directly or indirectly by controlling the movement of the baseplate 704-1, one or more holes 705, and/or any other suitable component of the system 700. Knowing the positions of the one or more strands of warp yarn 706, the controller 716 can control the actuator 708, the weaving arm 714, and/or other suitable component of the system 700 so as to cause the weft yarn 712 to alternately weave in and out of the strands of warp yarn 706. In some embodiments, the controller 716 can also be configured to control the actuator 708, the weaving arm 714, and/or other suitable component of the system 700 so as to cause the weft yarn 712 to stitch into and/or around one or more strands of warp yarn 706. The controller 716 can control the components of the system 700 through electrical signals, mechanical force, hydraulic liquid pressure, or any other suitable energy forms or combinations thereof. In some embodiments, the controller 716 can be embedded in the system 700 and located at any suitable locations of the system 700. In some embodiments, the controller 716 can be further broken down into one or more sub-controllers. For example, the baseplate 704-1, the actuator 708, and the weaving arm 714 can be each controlled by a sub-controller. In some embodiments, the controller 716 is located separated from the system 700. For example, the controller 716 can be located remotely and control components of the system 700 through wireless signals. Non-limiting examples the controller 716 include desktop computers, portable computers, embedded microcontrollers, smartphones, tablets, and any suitable devices that can communicate remotely or locally with other components.

Figure 9:
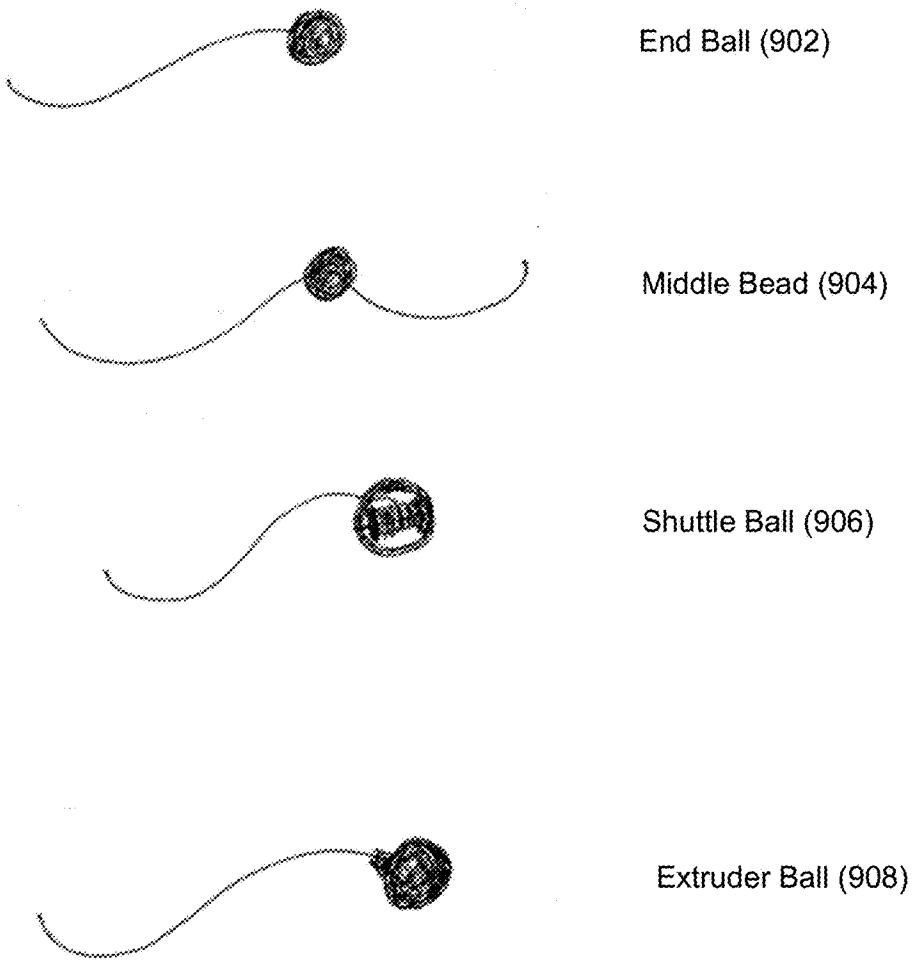
FIG. 9 illustrates various configurations of balls used to pass weft yarn in accordance with certain embodiments of the disclosed subject matter.
Figure 11:
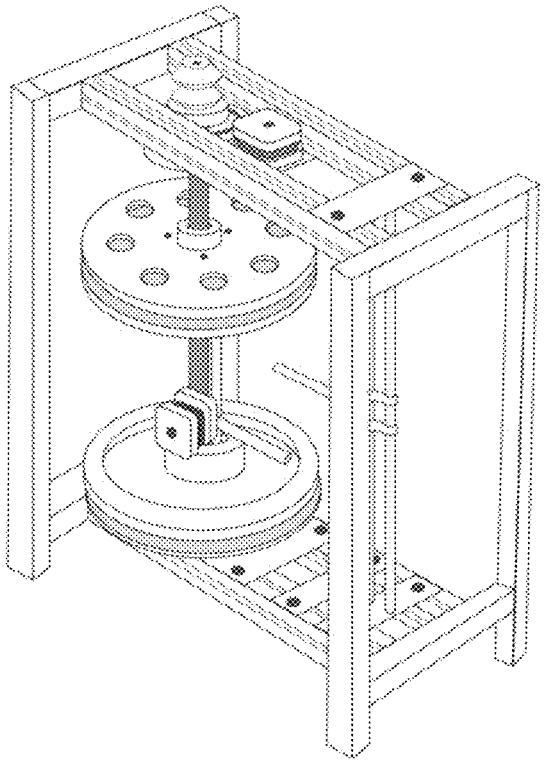
FIG. 11 illustrates a system for creating woven textile products in accordance with an embodiment of the disclosed subject matter.

The system 700 can have any suitable shape and/or the arrangement of the components. For example, FIG. 11 shows a system 700 in accordance with another embodiment of the present invention FIG. 9 illustrates four different ways the ball 718 can be used to pass the weft yarn 712. For example, in a configuration of an end ball 902, the ball 718 is connected to an end of the weft yarn 712. In a configuration of a middle bead 904, the weft yarn 712 passes through the ball 718, and the ball 718 slides along the weft yarn 712. In a configuration of a shuttle ball 906, the weft yarn 712 spins on an inner axle of the ball 718. In a configuration of an extruder ball 908, fibers can be extruded from the ball 718 and form the weft yarn 712. Any other suitable configuration or combination of configurations that is appreciated by a person skilled in the art is also within the spirit and limit of the disclosed subject matter.

Figure 10:
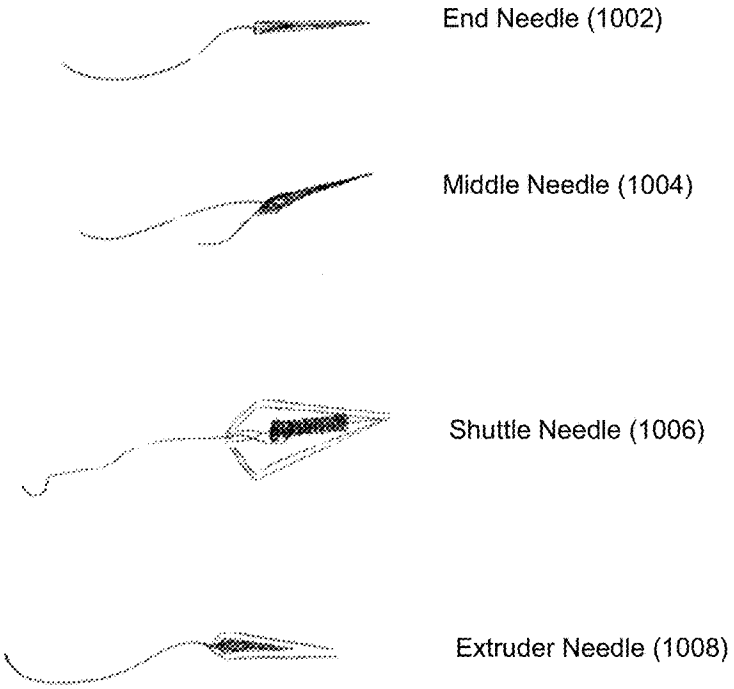
FIG. 10 illustrates various configurations of needles used to pass weft yarn in accordance with certain embodiments of the disclosed subject matter.

Although FIG. 7 shows the weft yarn 712 is passed by the ball 718, the weft yarn 712 can be passed by a similar device with any suitable shape and configuration. For example, FIG. 10 illustrates the weft yarn can be passed by a needle-shape device. Specifically, in a configuration of an end needle 1002, the needle is connected to an end of the weft yarn 712. In a configuration of a middle needle 1004, the weft yarn 712 passes through the needle, and the needle slides along the weft yarn 712. In a configuration of a shuttle needle 1006, the weft yarn 712 spins on an inner axle of the needle. In a configuration of an extruder needle 1008, fibers can be extruded from the needle and form the weft yarn 712. Any other suitable configuration or combination of configurations that is appreciated by a person skilled in the art is also within the spirit and limit of the disclosed subject matter.

Figure 12:
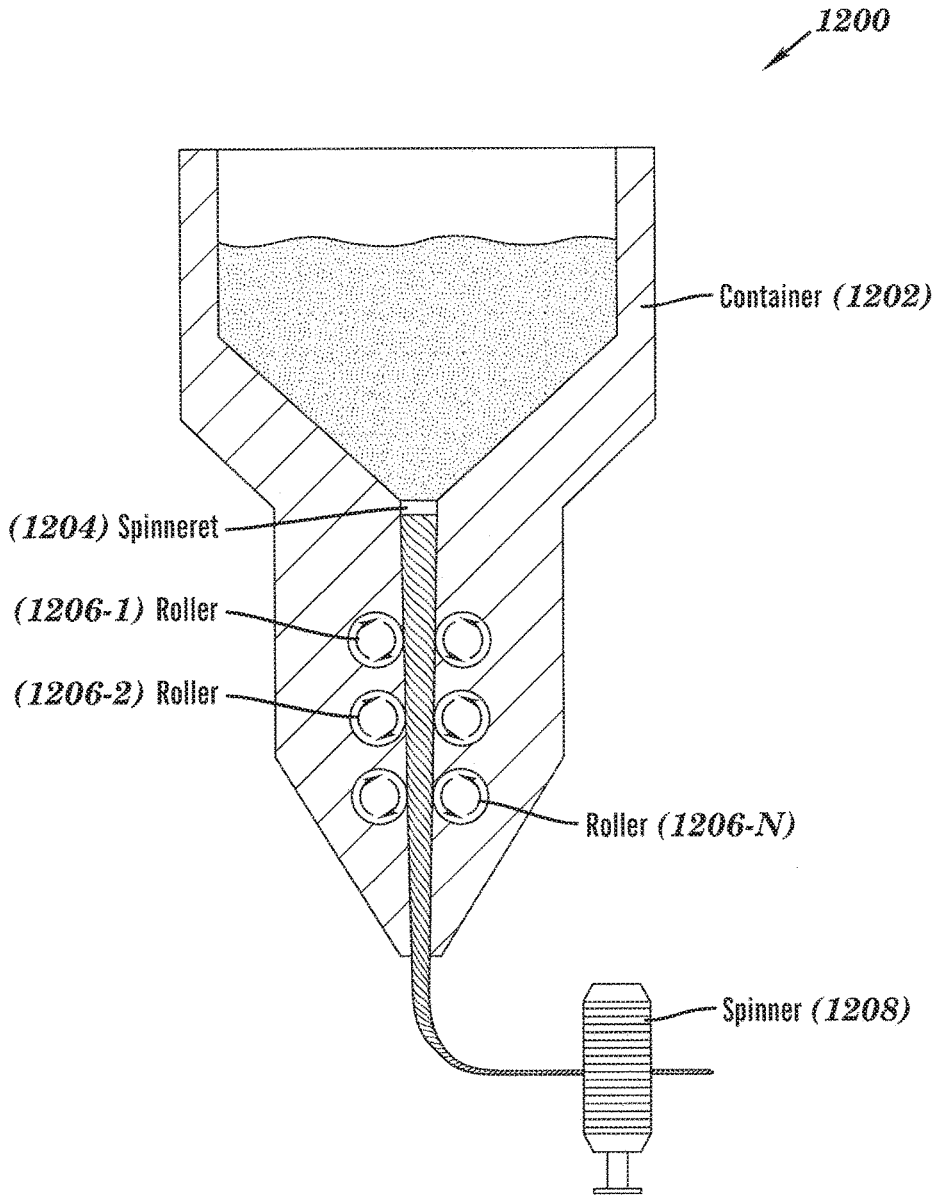
FIG. 12 illustrates a yarn generator in accordance with an embodiment of the disclosed subject matter.

FIG. 12 illustrates a yarn generator 1200 in accordance with an embodiment of the disclosed subject matter. The yarn generator 1200 includes a container 1202, a spinneret 1204, one or more rollers 1206 (e.g., roller 1206-1, 1206-2, . . . 1206-N), and a spinner 1208. The components included in the yarn generator 1200 can be further broken down into more than one component and/or combined together in any suitable arrangement. Further, one or more components can be rearranged, changed, added, and/or removed. The yarn generator 1200 can be used for melt spinning, dry spinning, wet spinning, gel spinning, or any other spinning technique or combination of techniques that is appreciated by a person skilled in the art.

The container 1202 is used to hold one or more types of solution. In some embodiments, the container 1202 has a top opening on the top surface and a bottom opening on the bottom surface. In some embodiments, the container 1202 can be in a shape of a hopper container. The solution can be added from outside to the container 1202 through the top opening, and the solution can flow to the spinneret 1204 through the bottom opening. In some embodiments, the container 1202 has a heating element and can receive and melt one or more types of polymer to become a solution. Non-limiting examples of polymer includes plastic, wood pulp, protein, mineral, or any other suitable material or combination of materials.

The spinneret 1204 has a plurality of holes. In some embodiments, the spinneret 1204 has the shape of a circular plate and resembles a showerhead configuration. The spinneret 1204 is configured to receive the solution from the container 1202 and to output a plurality of continuous filaments from the plurality of holes of the spinneret 1204. In some embodiments, hot air can be used to help evaporate liquid from the solution when the solution is polymerized and filaments are extruded from the spinneret 1204. In some embodiments, the spinneret 1204 is submerged in a second solution, and the solution from the container 1202 and the second solution interact to form a polymer while filaments are extruded from the spinneret 1204. In some embodiments, the solution becomes a gel-like state polymer when the solution gets extruded from the spinneret 1204, and the gel-like state polymer can become filament after being air dried and cooled in a liquid.

The one or more rollers 1206 is configured to receive the plurality of continuous filaments from the spinneret 1204 and to stretch them out. Although FIG. 12 shows six rollers, any suitable number of rollers can be used. Further, the rollers can be configured to rotate either clockwise or counterclockwise.

The spinner 1208 is configured to receive and twist the stretched plurality of continuous filaments from the rollers 1206 to form yarn. Once yarn is formed, it can be used to supply at least one of the strand of warp yarn and/or at least one of the strands of weft yarn in the system 400 and/or the system 700.

One or more yarn generators 1200 can be configured to supply at least one of the strand of warp yarn and/or at least one of the strand of weft yarn in the system 400, the system 700, and/or any other suitable system. In some embodiments, the yarn generator 1200 can be a part of the system 400 and/or the system 700. Using the yarn generator 1200 to supply the strand of warp yarn and/or the strand of weft yarn has several advantages, including capable of dynamically changing materials forming yarns during the weaving process.

Figure 13:
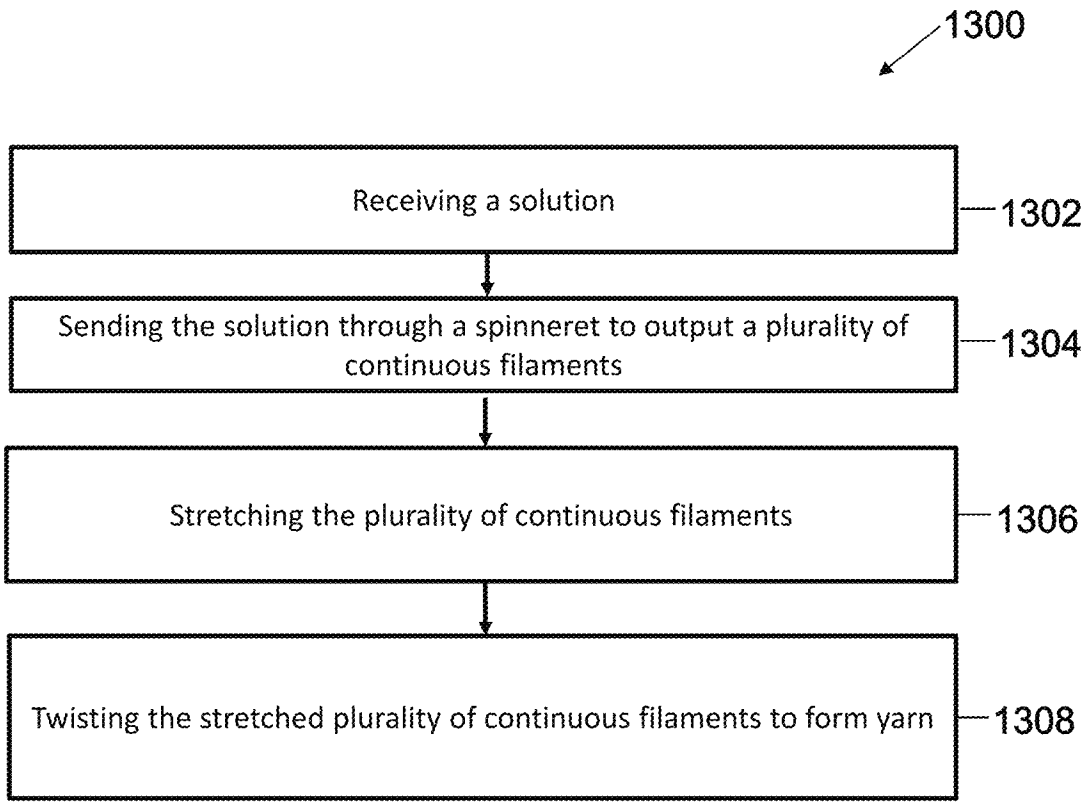
FIG. 13 is a flow diagram illustrate a process of generating yarns in accordance with an embodiment of the disclosed subject matter.

FIG. 13 is a flow diagram illustrating a process 1300 of generating yarns from polymer or polymer solution in accordance with an embodiment of the disclosed subject matter. The process 1300 is illustrated in connection with the yarn generator 1200 shown in FIG. 12. In some embodiments, the process 1300 can be modified by, for example, having steps rearranged, changed, added, and/or removed.

At step 1302, one or more types of solution is received in a container 1202. In some embodiments, the container 1202 has a heating element and can receive and melt one or more types of polymer to become a solution. Non-limiting examples of polymer includes plastic, wood pulp, protein, mineral, or any other suitable material or combination of materials. The process 1300 then proceeds to step 1304.

At step 1304, the solution from the container 1202 is sent through the spinneret 1204 to output a plurality of continuous filaments. In some embodiments, hot air can be used to help evaporate liquid from the solution when the solution is polymerized and filaments are extruded from the spinneret 1204. In some embodiments, the spinneret 1204 is submerged in a second solution, and the solution from the container 1202 and the second solution interact to form a polymer while filaments are extruded from the spinneret 1204. In some embodiments, the solution becomes a gel-like state polymer when it gets extruded from the spinneret 1204, and the gel-like state polymer can become filaments after being air dried and then cooled in a liquid. The process 1300 then proceeds to step 1306.

At step 1306, the plurality of continuous filaments from the spinneret 1204 are stretched out by one or more rollers 1206. The process 1300 then proceeds to step 1308.

At step 1308, the stretched plurality of continuous filaments are twisted by the spinner 1208 to form yarn.

Figure 14:
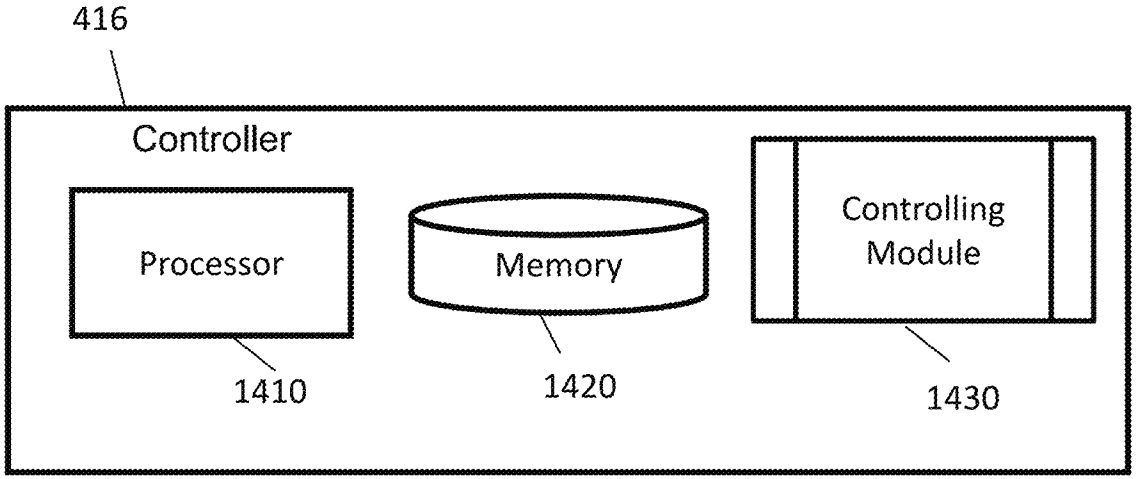
FIG. 14 illustrates a block diagram of a controller in accordance with an embodiment of the disclosed subject matter.

FIG. 14 is a block diagram of an exemplary controller 416 in accordance with some embodiments. The controller 416 includes a processor 1410, a memory 1420, and a controlling module 1430. The controller 416 can communicate with other components shown in FIG. 4 and/or FIG. 7. The controller 416 can also communicate with the Internet. The controller 416 may include additional modules, fewer modules, or any other suitable combination of modules that perform any suitable operation or combination of operations. For example, the controller 416 may include more than one processor 1410. Although the controller 416 is illustrated in connection with components in the system 400, the controller 416 can have similar or the same functionalities as the controller 716 in the system 700.

In some embodiments, the processor 1410 can include one or more cores and can accommodate one or more threads to run various applications and modules, including the controlling module 1430.

The controlling module 1430 can be configured to cause the baseplate 404 to rotate in a circular motion around an axis of the baseplate 404. The controlling module 1430 can be configured to cause the weft yarn 412 to move forwards and backwards in a direction parallel to the top surface of the baseplate 404 so as to cause the strand of weft yarn 412 to alternately weave in and out of the strands of warp yarn 406. The controlling module 1430 can be configured to cause the strand of weft yarn 412 to move in a direction away from the top surface of the baseplate 404 so as to cause the strand of weft yarn 412 to alternately weave in and out of the strands of warp yarn 406 at a different height to create a 3D woven textile product.

As discussed above, in some embodiments, once a strand of weft yarn has alternately woven in and out of strands of warp yarn at a given height, the strand of weft yarn can move up or down to a different height to continue the weaving process so that a 3D woven textile product can be eventually created. Further, the location and orientation of the strands of warp yarn can be dynamically adjustable so that the shape and profile of the 3D woven textile product can be varied at different height. The disclosed 3D weaving technology can be used to create various textile products, such as, without limitations, a shirt, a vest, a coat, a body armor, a pair of pants, a dress, a skirt, a pair of socks, shoes, a tent, a backpack, a parachute, a composite boat shell, a composite plane shell, a composite bike shell, a sleeping bag shell, etc.

The disclosed subject matter provides systems and methods for creating 3D woven textile products. In some embodiment, the 3D woven textile products can be created without seams. Seamless woven textile products have many advantages over seamed textile products or knitted textile products. For example, seamless woven textile products do not require seams, which create weak points where failure often happens, and therefore have a stronger and more dimensionally stable structure. Seamless woven textile products also provide more insulation against the elements such as water, wind, heat, or cold. In some embodiments, one or more yarn generators can be included in the system of the disclosed subject matter. The one or more yarn generators can be configured to supply at least one of the strand of warp yarn and/or at least one of the strand of weft yarn. The one or more yarn generators can be configured to dynamically change materials forming yarns during the weaving process so that different portions of the textile products can have different strength, material, thickness, etc. In general, seamless woven textile products are typically less bulky, more comfortable, lighter, and having more streamlined design than other textile products.

In some embodiments, the controlling module 1430 can be implemented in software stored in the memory 1420 and/or located within the memory 1420. The memory 1420 can be a non-transitory computer readable medium, flash memory, a magnetic disk drive, an optical drive, a programmable read-only memory (PROM), a read-only memory (ROM), or any other memory or combination of memories. The software can run on a processor 1410 capable of executing computer instructions or computer code. The processor 1410 might also be implemented in hardware using an application specific integrated circuit (ASIC), programmable logic array (PLA), field programmable gate array (FPGA), or any other suitable discrete or integrated circuit. The processor 1410 also communicates with the memory 1420 and interfaces 504-508 to communicate with other devices. The processor 1410 can be any applicable processor such as a system-on-a-chip that combines a CPU, an application processor, and flash memory.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the claims be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter, which is limited only by the claims which follow.

What is claimed is:

1. An apparatus for creating a three-dimensional woven textile product, comprising:

a base;

a baseplate mounted on a top surface of the base:

the baseplate having a two-dimensional configuration of holes along a top surface of the baseplate, wherein each of the holes has a strand of warp yarn that extends from the hole in a direction away from the top surface of the baseplate, and the baseplate having an axis around which the baseplate is configured to rotate in a circular motion;

an actuator configured to move a strand of weft yarn forwards and backwards in a direction parallel to the top surface of the baseplate so as to cause the strand of weft yarn to alternately weave in and out of the strands of warp yarn;

a weaving arm, having mounted thereon the actuator, and mounted on the top surface of the base, the weaving arm configured to move the actuator in a direction away from the top surface of the baseplate so as to cause the strand of weft yarn to alternately weave in and out of the strands of warp yarn at a different height to create a three-dimensional woven textile product; and a controller configured to control operation of the baseplate, the actuator, and the weaving arm.

2. The apparatus of claim 1, wherein the direction that the strand of warp yarn extends from each hole away from the top surface of the baseplate is the same for at least two of the strands of warp yarn.

3. The apparatus of claim 1, wherein the direction that the strand of warp yarn extends from each hole away from the top surface of the baseplate is different for at least two of the strands of warp yarn.

4. The apparatus of claim 1, wherein the direction that the strand of warp yarn extends from each hole away from the top surface of the baseplate is dynamically adjustable for at least two of the strands of warp yarn.

5. The apparatus of claim 1, wherein a location of each of the holes along the top surface of the baseplate is dynamically adjustable.

6. The apparatus of claim 1, wherein the baseplate comprises at least one hole dynamically added or removed along the top surface of the baseplate, and the at least one hole has a strand of warp yarn that extends from the at least one hole in a direction away from the top surface of the baseplate.

7. The apparatus of claim 1, wherein the baseplate is configured to permit the strand of warp yarn extending from each hole to be dynamically added or removed.

8. The apparatus of claim 1, wherein the weaving arm is further configured to move the actuator in the direction away from the top surface of the baseplate after the actuator has caused the strand of weft yarn to alternately weave in and out of the strands of warp yarn approximately once at a particular height.

9. The apparatus of claim 1, wherein the actuator includes two arms configured to alternately hold a ball that is coupled to the strand of weft yarn, wherein at least one of the two arms is configured to move the ball forwards and backwards in a direction parallel to the top surface of the baseplate so as to cause the strand of weft yarn to alternately weave in and out of the strands of warp yarn.

10. The apparatus of claim 1, further comprising a yarn generator configured to supply at least one of the strand of warp yarn or the strand of weft yarn.

11. The apparatus of claim 10, wherein the yarn generator comprises:

a container containing a solution;

a spinneret having a plurality of holes, and is configured to receive the solution and to output a plurality of continuous filaments from the plurality of holes;

a plurality of rollers configured to receive and stretch the plurality of continuous filaments; and a spinner coupled to receive and twist the stretched plurality of continuous filaments to form yarn.

12. The apparatus of claim 11, wherein the spinneret is submerged in a second solution, wherein the solution and the second solution interact to form a polymer.

13. The apparatus of claim 11, wherein the container has a heating element and is configured to receive and melt at least one type of polymer to become the solution.

14. The apparatus of claim 13, wherein the at least one type of polymer comprises one or more of plastic, wood pulp, protein, or mineral.

* * * * *